US008306450B2

(12) United States Patent
Tsusaka et al.

(10) Patent No.: US 8,306,450 B2
(45) Date of Patent: Nov. 6, 2012

(54) TONER RECOVERY MACHINE AND IMAGE FORMING APPARATUS

(75) Inventors: Shusaku Tsusaka, Nagoya (JP); Eiji Kawahara, Nagoya (JP); Takamasa Tsukada, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 12/732,821

(22) Filed: Mar. 26, 2010

(65) Prior Publication Data

US 2010/0303497 A1 Dec. 2, 2010

(30) Foreign Application Priority Data

May 28, 2009 (JP) ..... 2009-129557

(51) Int. Cl.
*G03G 15/16* (2006.01)

(52) U.S. Cl. ..... 399/101

(58) Field of Classification Search ..... 399/34, 399/35, 99, 123, 343, 349
See application file for complete search history.

(56) References Cited

U.S. PATENT DOCUMENTS

| | | | | |
|---|---|---|---|---|
| 7,970,297 | B2 * | 6/2011 | Inoue et al. | 399/35 |
| 2006/0039711 | A1 * | 2/2006 | Shibuya et al. | 399/44 |
| 2009/0116853 | A1 | 5/2009 | Okazaki et al. | |

FOREIGN PATENT DOCUMENTS

| | | |
|---|---|---|
| JP | 09-194013 | 7/1997 |
| JP | 2009-116095 | 5/2009 |

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

A toner recovery machine comprising: a first roller having a radius and rotatable about a first axis, the first axis along a first direction; a cleaner touching the first roller; a container for accommodating toner, the container comprising: a first conveyer movable along a second direction perpendicular to the first direction; and a second conveyer rotatable about a second axis and having a radius defined by the rotation about the second axis, the second axis along the first direction, wherein the second conveyer, the first roller, and the first conveyer are positioned in this order along the second direction, wherein the sum of the radius of the first roller and the radius defined by the second conveyer is smaller than a distance in the second direction between the first axis and the second axis.

10 Claims, 13 Drawing Sheets

TONER RECOVERY MACHINE AND IMAGE FORMING APPARATUS

CROSS REFERENCE TO RELATED APPLICATIONS

The present application claims priority form Japanese Patent Application No. JP-2009-129557 filed on May 28, 2009, and the subject matter of which is incorporated herein by reference.

TECHNICAL FIELD

The present invention relates to a toner recovery machine and an image forming apparatus.

BACKGROUND

A toner recovery machine of related art is arranged with an offset belt. The offset belt acts as a toner carrier that circulates while directly carrying toner on the surface of a recording medium on which an image has already been formed. The toner recovery machine includes a cleaning roller, a waste toner container, first conveyer and second conveyer.

The cleaning roller has a first rotation shaft orthogonal to the circulation direction of the offset belt. The cleaning roller rotates around the first rotation shaft and recovers waste toner carried on the offset belt on the surface thereof. The waste toner container supports the first rotation shaft in a state where a part of the cleaning roller is exposed. With the part of the cleaning roller, waste toner can be recovered. The waste toner container accommodates waste toner recovered by the cleaning roller.

The first conveyer includes a toner conveyance regulating member reciprocating in the vertical direction and a conveying plate reciprocating in the horizontal direction. And, the first conveyer conveys waste toner, which is accommodated in the waste toner container, in the first pile-up direction being the direction apart from the cleaning roller by the linked operation of the toner conveyance regulating member and the conveying plate.

The second conveyer is a conveying screw having a second rotation shaft parallel to the first rotation shaft and extending in the waste toner container The second conveyer is located at the same side as the first conveyer on the basis of the first rotation shaft and is located at a further downstream side in the first pile-up direction than the first conveyer. And, the second conveyer rotates around the second rotation shaft and conveys waste toner in the second pile-up direction. The second pile-up direction is the direction from one end side of the second rotation shaft to the other end side thereof.

The toner recovery machine recovers the toner carried on the offset belt by means of the cleaning roller when the offset belt circulates while carrying toner adhered to the surface of a recording medium, and accommodates the waste toner in the waste toner container. And, the waste toner recovery machine conveys the accommodated waste toner to the downstream side in the first pile-up direction by the first conveyer, in other words, toward the second conveyer, and fills the waste toner in the waste toner container by further conveying the same in the second pile-up direction by the second conveyer.

A request for downsizing has been increased with respect to an image forming apparatus in which a toner recovery machine is incorporated. In line therewith, downsizing and thinning are requested in regard to the entire toner recovery machine. In addition, if the toner recovery machine is thoughtlessly downsized and thinned, this brings about a decrease in capacity of the waste toner container. Therefore, filling toner in a waste toner container as much as possible, that is, increasing the filling ratio of waste toner in the waste toner container is simultaneously requested.

With respect to the above-described point, in the related art toner recovery machine, waste toner recovered by a cleaning roller drops at the downstream side in the first pile-up direction by the first rotation shaft in the waste toner container, and is conveyed to a further downstream side in the first pile-up direction as it is. Therefore, it is not possible to accommodate waste toner up to a space under the cleaning roller or the upstream side in the first pile-up direction in the waste toner container, wherein it is difficult to increase the filling ratio of waste toner accommodated in the waste toner container. In this case, if the toner recovery machine is downsized and thinned, the quantity of waste toner that can be accommodated in the waste toner container decreases, and as a result, there is a fear that time and labor required for a user to replace a toner recovery machine and maintenance costs are increased.

SUMMARY

The exemplary embodiments of the present invention was developed in view of the above-described situations, and it is therefore an object of the exemplary embodiments to provide a toner recovery machine capable of achieving downsizing and thinning as the entire unit while increasing the filling ratio of waste toner accommodated in a waste toner container.

The first aspect of the exemplary embodiments of the present invention is A toner recovery machine comprising: a first roller having a radius and rotatable about a first axis, the first axis along a first direction; a cleaner touching the first roller; a container for accommodating toner, the container comprising: a first conveyer movable along a second direction perpendicular to the first direction, wherein the second conveyer, the first roller, and the first conveyer are positioned in this order along the second direction, and a second conveyer rotatable about a second axis and having a radius defined by the rotation about the second axis, the second axis along the first direction, wherein the sum of the radius of the first roller and the radius defined by the second conveyer is smaller than a distance in the second direction between the first axis and the second axis.

According to the first aspect of the exemplary embodiments of the present invention, when a toner carrier circulates while directly carrying toner or indirectly carrying toner through a recording medium, the first roller recovers waste toner not transferred on the surface of the recording medium from the surface of the toner carrier to the surface thereof. Then the container accommodates the recovered waste toner.

The first conveyer moves along the second direction so as to convey the waste toner in the second direction. After the amount of the waste toner reaches a certain amount so that the first conveyer becomes hard to convey the waste toner in the second direction, the waste toner begins to pile-up toward the second conveyer. The second conveyer conveys the waste toner in the first direction.

In this situation, since the second conveyer is provided in the container so that the sum of the radius of the first roller and the radius defined by the second conveyer is smaller than a distance in the second direction between the first axis and the second axis, the container can accommodate the waste toner up to a space under the first roller, that is, a space under the first roller, and up to the vicinity thereof. Therefore, as compared to the related toner recovery machine, it is facile to increase the filling ratio of the container. Also, for the virtue of the above positioning relationship between the first roller and the second conveyer, the second conveyer can be positioned in the container independently from the first roller without any spatial limitation. Therefore, it is possible to reduce the thickness of the container.

Thus, according to the first aspect of the exemplary embodiments of the present invention achieves to increase the filling ratio of the waste toner in the container. Also the first aspect achieves downsizing of the container and reduce the thickness of the container.

DESCRIPTION OF EXEMPLARY EMBODIMENTS

Hereinafter, a description is given of an embodiment being an example of a detailed configuration of the present invention with reference to the drawings.

Exemplary Embodiment

Figure 1:
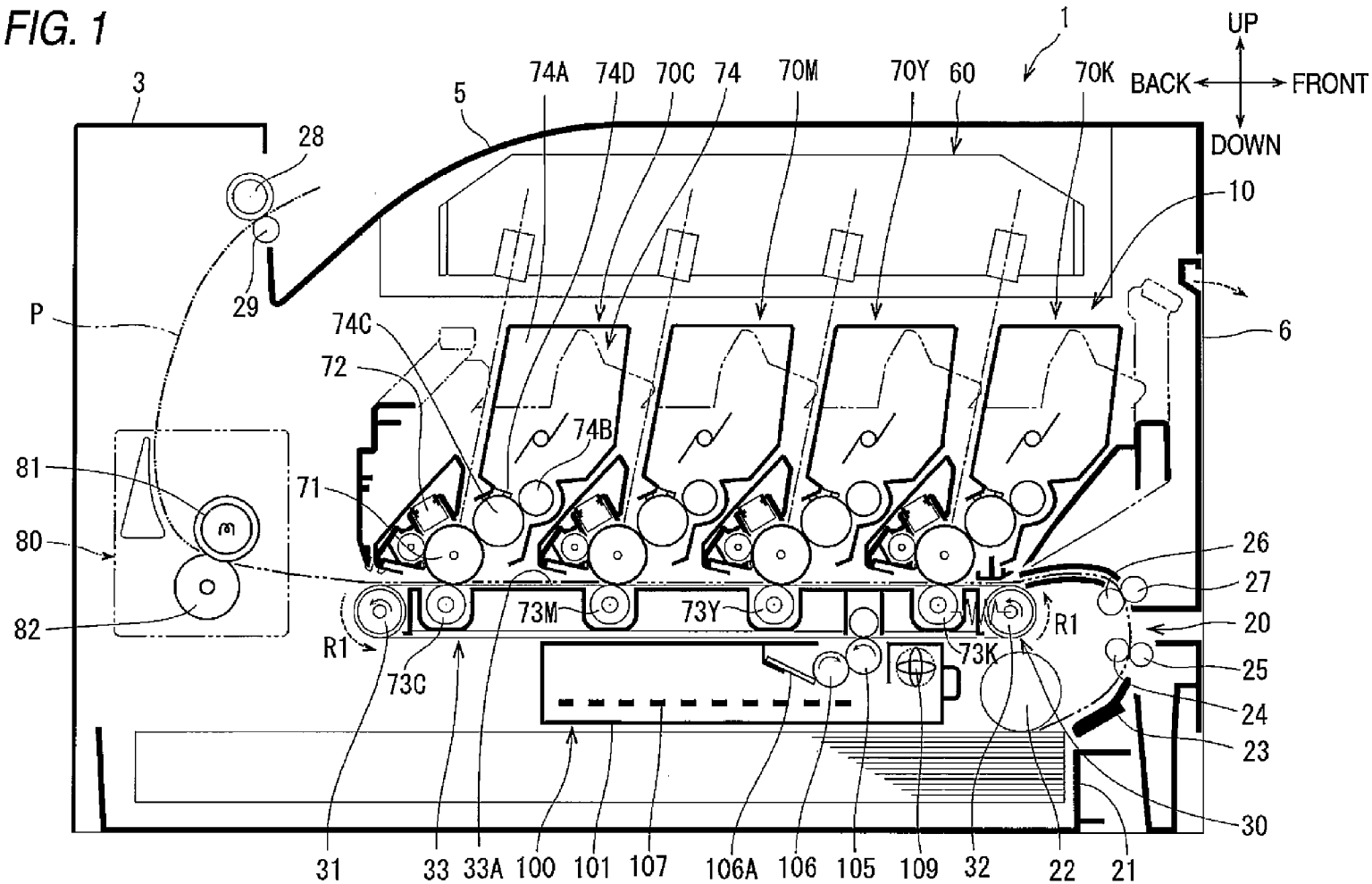
FIG. 1 is a schematically sectional view of an image forming apparatus to which a toner recovery machine according to an embodiment is applied.

As shown in FIG. 1, a toner recovery machine 100 according to the embodiment is applied to a printer 1 that is one example of an image forming apparatus. The printer 1 is a color laser printer that forms images consisting of a plurality of colors on a sheet (including an OHP sheet, etc.) being a medium to be recorded, by means of an electro-photographic system. In FIG. 1, it is assumed that the right side of the paper is the front side of the apparatus, and the left side thereof is the rear side of the apparatus, and it is assumed that the side (this side of the paper) appearing leftward when being observed from the front side of the apparatus is the left side, and the opposite side thereof is the right side. Respective directions of the front, rear, right, left, up and down are expressed under this assumption. And, the respective directions of the front, rear, right, left, up and down shown in FIG. 2 through FIG. 14 are all expressed so as to correspond to the respective directions of FIG. 1. Hereinafter, based on FIG. 1, a detailed description is given of the toner recovery machine 100 after respective components equipped in the printer 1 are described.

1. Schematic Configuration of Printer

A housing 3 is roughly box-shaped, and a frame member (not illustrated) is provided inside the housing 3. To the frame member are attached a sheet feeder 20, an image forming unit 10, a conveying unit 30, a fixing unit 80 and a toner recovery machine 100, etc. The image forming unit 10 is positioned roughly at the middle part of the housing 3.

A discharge tray 5 on which sheets discharged from discharge rollers 28 and 29 are placed after images are formed is provided on the upper surface side of the housing 3. A front cover 6 that can be opened and closed using the lower end side as its rocking center axis is provided at the front side of the housing 3. The image forming unit 10 and the conveying unit 30 are structured so as to be detachable with respect to the frame member in a state where the front cover 6 is opened. Since a detailed structure for making the image forming unit 10 and the conveying unit 30 detachable with respect to the frame member is publicly known, the description thereof is omitted. In addition, the toner recovery machine 100 is also structured so as to be detachable with respect to the frame member in a state where the image forming unit 10 and the conveying unit 30 are removed from the housing 3. A detailed structure for making the toner recovery machine 100 detachable with respect to the frame member will be described later.

2. Sheet Feeder

A sheet feeder 20 includes a sheet feeder tray 21 detachably accommodated under the housing 3, a sheet feeder roller 22 provided at the upper front end part of the sheet feeder tray 21, which feeds (conveys) sheets placed on the sheet feeder tray 21 to the image forming unit 10, and a separation pad 23 for separating sheets fed by the sheet feeder roller 22 one by one by giving predetermined conveying resistance to the sheets, etc.

And, conveying rollers 24 and 25, which give a conveying force to sheets conveyed to the image forming unit 10 while being curved to be roughly U-shaped, are disposed at a forward portion turned to be roughly U-shaped in a sheet conveying path P (shown by a thick two-dotted chain line in FIG. 1).

Also, registration rollers 26 and 27 are provided at a further downstream side of the conveying path P than the conveying rollers 24 and 25, which further convey sheets toward the image forming unit 10 after correcting for stewing of the sheets by being brought into contact with the tip ends of the sheets conveyed by the conveying rollers 24 and 25.

3. Conveying Unit

The conveying unit 30 is disposed between the sheet feeder tray 21 located downward and the image forming unit 10 located upward, and includes a conveying belt 33 and transfer rollers 73K, 73Y, 73M and 73C, etc.

The conveying belt 33 is wound between a drive roller 31 located at the lower rear end side of the image forming unit 10 and a driven roller 32 located at the lower front end side of the image forming unit 10. And, by the drive roller 33 rotating in synchronization with the registration rollers 26 and 27 of the sheet feeder 20, the conveying belt 33 circulates between the drive roller 31 and the driven roller 32. FIG. 1 shows the circulation direction R1 of the conveying belt 33. The upper plane of the conveying belt 33 is disposed roughly horizontally immediately below the image forming unit 10, and is made into a sheet conveying plane 33A, which conveys sheets along the conveying path P, by being brought into contact with the back side of the sheets.

The transfer rollers 73K through 73C are provided on the conveying unit 30 in a state where the rollers are in contact with the conveying belt 33 from the back side of the sheet conveying plane 33A. Since the conveying belt 33 is made of conductive rubber, the conveying roller 33 is charged by negative charge (transfer voltage) applied onto the respective transfer rollers 73K through 73C. Therefore, the conveying belt 33 can convey sheets along the conveying path P while adsorbing the sheets onto the sheet conveying plane 33A by an electrostatic force. Further, the conveying belt 33 circulates while indirectly carrying a toner image described later via sheets by an electrostatic force.

4. Image Forming Unit

The image forming unit 10 is a so-called direct tandem type that is able to carry out color printing, and includes four process cartridges 70K, 70Y, 70M and 70C and a scanner unit 60, etc. The scanner unit 60 is disposed extremely upward inside the housing 3. The four process cartridges 70K, 70Y, 70M and 70C correspond to four colors of toner (developing agents), black, yellow, magenta and cyan, and are disposed in series from upstream to downstream in the sheet conveying plane 33A.

4.1. Scanner Unit

The scanner unit 60 includes a laser light source, a polygon mirror, an fθ lens, and a reflection mirror, etc. A laser beam emitted from the laser light source is irradiated onto the surface of a photosensitive drum 71 disposed in each of the process cartridges 70K through 70C by its light path being folded over by the reflection mirror and being bent downward by the reflection mirror after the laser beam is polarized by the polygon mirror and passes through the fθ lens, and an electrostatic latent image is thereby formed.

4.2. Process Cartridge

The process cartridges 70K through 70C are identical to each other except that the colors of toner acting as a coloring agent are different from each other. Hereinafter, a description is given of the structure thereof, taking the process cartridge 70C as an example.

The process cartridge 70C is composed so as to include a publicly known photosensitive drum 71, an electric charger 72 and a toner cartridge 74, etc.

The toner cartridge 74 includes a toner accommodation chamber 74A having toner accommodated therein, a toner supply roller 74B and a developing roller 74C, etc. And, toner in the toner accommodation chamber 74A is supplied to the developing roller 74C side by rotation of the toner supply roller 74B, and is carried on the surface of the developing roller 74C, and is supplied onto the surface of the photosensitive drum 71 after the toner is adjusted to a predetermined thickness by a layer thickness regulating blade 74D. The photosensitive drum 71 is disposed at the opposite side of the transfer roller 73C with the sheet conveying plane 33A of the conveying belt 33 placed therebetween.

5. Fixing Unit

The fixing unit 80 is disposed at a further downstream side than the process cartridges 70K through 70C in the sheet conveying path P. The fixing unit 80 includes a heating roller 81 and a pressing roller 82. The heating roller 81 is disposed at the image forming plane side of a sheet, rotates in synchronization with the conveying belt 33, etc., and gives a conveying force to the sheet while heating toner transferred onto the sheet. On the other hand, the pressing roller 82 is disposed at the opposite side of the heating roller 81 with the sheet placed therebetween, and is driven and rotated while pressing the sheet to the heating roller 81 side. Therefore, the fixing unit 80 heats and melts toner transferred onto a sheet and fixes the same onto the sheet, and at the same time, conveys the sheet to the downstream side of the conveying path P. In addition, the conveying path P is curved to be roughly U-shaped upward at the downstream side of the fixing unit 80. And, the discharge rollers 28 and 29 for discharging a sheet having an image formed thereon into the discharge tray 5 is provided immediately before the discharge tray 5 being at the extremely downstream side of the conveying path P.

6. Brief Description of Image Forming Operation

In the printer 1 thus constructed according to the embodiment, an image is formed on a sheet as described below. That is, when an image forming operation is commenced, the sheet feeder unit 20 and the conveying unit 30 start, and a sheet is conveyed to the image forming unit 10, and the scanner unit 60 and the process cartridges 70K through 70C, etc., start. So, after the surface of the rotating photosensitive drum 71 is positively charged uniformly by the electric charger 72, the surface is exposed by a laser beam irradiated from the scanner unit 60. As a result, an electrostatic latent image corresponding to image forming data is formed on the surface of the photosensitive drum 71.

Next, by rotation of the developing roller 74C, positively charged toner carried on the developing roller 74C is supplied to the electrostatic latent image formed on the surface of the photosensitive drum 71 when the toner is opposed to and brought into contact with the photosensitive drum 71. Thereby, the electrostatic latent image of the photosensitive drum 71 is visualized, and a toner image based on reversal development is carried on the surface of the photosensitive drum 71.

After that, the toner image carried on the surface of the developing drum 71 is transferred onto a sheet by a transfer voltage applied to the transfer rollers 73K through 73C. And, as the conveying belt 33 conveys the sheet to the fixing unit 80 while indirectly carrying the toner image via the sheet, the toner image transferred onto the sheet is heated and pressed by the heating roller 81 and the pressing roller 82, and is fixed on the sheet. Finally, the sheet having the image formed thereon is discharged to the discharge tray 5, and the image forming operation is finished. Here, the conveying belt 33 corresponds to a toner carrier according to the present invention.

7. Toner Recovery Machine

When the printer executes the image forming operation described above, there may be cases where a part of toner that the conveying belt 33 indirectly carries via a sheet is adhered to the conveying belt 33 without being transferred onto the sheet and becomes unnecessary toner (waste toner). And, if an image forming operation is carried out with waste toner adhered to the conveying belt 33, waste toner will be re-transferred to a sheet, wherein an unnecessary image that a user does not intend will be formed on the sheet. Therefore, the printer 1 is provided with a toner recovery machine 100 at the downside of the conveying unit 30, which recovers toner adhered to the conveying belt 33 as waste toner. Hereinafter, a detailed description is given of the toner recovery machine 100.

Figure 2:
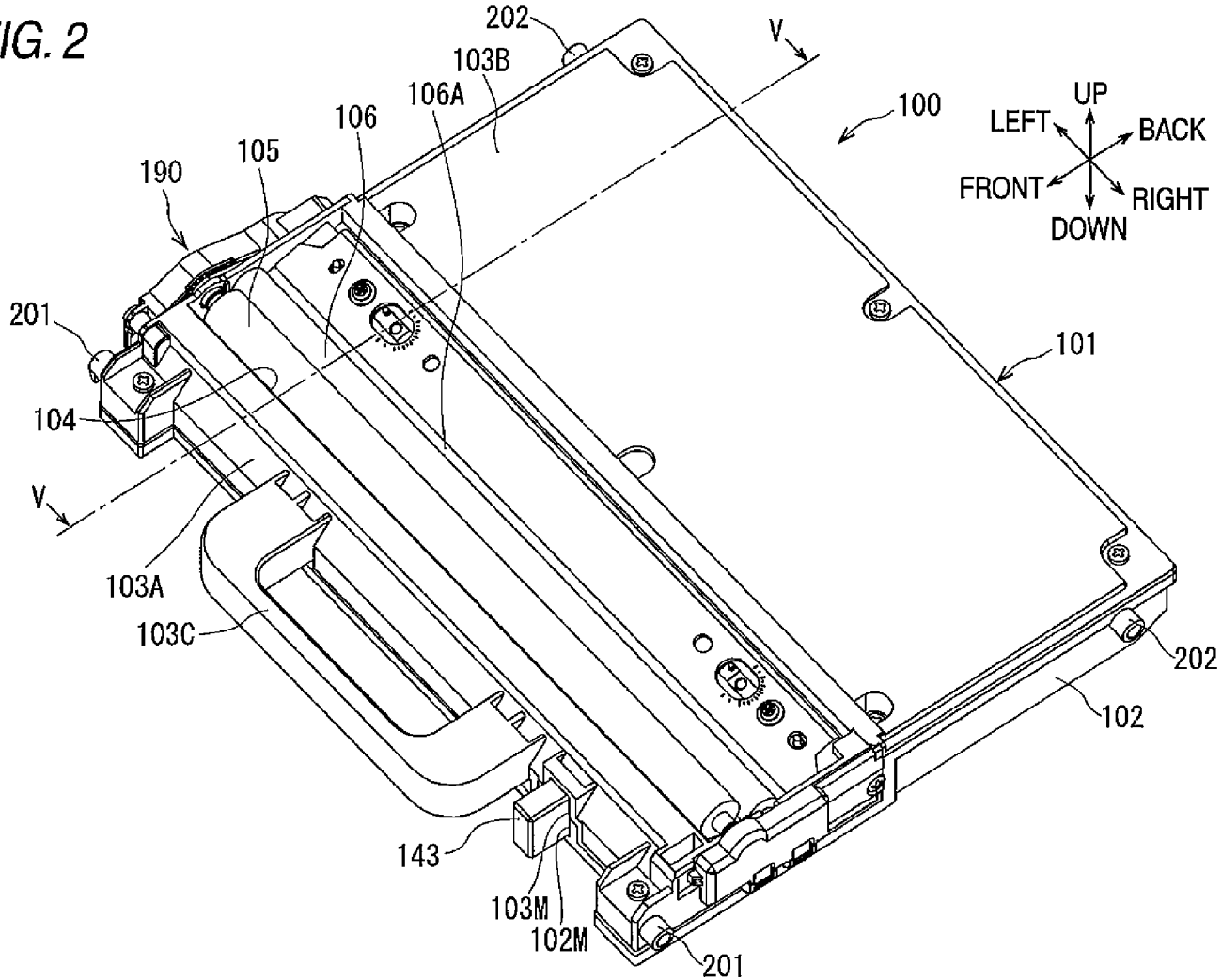
FIG. 2 is a perspective view of the toner recovery machine according to the embodiment.

As shown in FIG. 2, the toner recovery machine 100 as a simple body has a handle 103C protruded forward of a box-shaped waste toner container 101 that accommodates waste toner not transferred onto sheets.

The waste toner container 101 is composed, as shown in FIG. 2 through FIG. 8, of a box-shaped container main body the upper part side of which is open, an upper part cover 103A that covers the upper part front side of the container main body 102, and an upper part cover 103B that covers the upper part rear side of the container main body 102. The upper part covers 103A and 103B are assembled to the container main body 102 by means of tightening means such as screws so as to be separated therefrom.

A take-in port 104 opened substantially at the same width as the width of the conveying belt 33 is formed in the upper part cover 103A. The cleaning roller 105, raking roller 106 and blade 106A are arranged and provided in the take-in port 104 in this order in the front-rear direction.

As shown in FIG. 1, FIG. 2, FIG. 5 and FIG. 6, the cleaning roller 105 is a solid columnar body having a resin made sponge layer formed on the outer surface side thereof. The upper part cover 103A pivotally supports both ends of the first rotation shaft 105X (shown in FIG. 5 and FIG. 6) of the cleaning roller 105 in a state where the upper part of the cleaning roller 105 is exposed from the take-in port 104. The first rotation shaft 105X is parallel to the drive roller 31 and the driven roller 32 of the conveying unit 30. In other words, the first rotation shaft 105X is orthogonal to the circulation direction R1 of the conveying belt 33. And, the cleaning roller 105 is structured so as to be brought into contact with the conveying belt 33 from downward thereof in a state where the toner recovery machine 100 is mounted on the frame member.

The raking roller 106 is a metal-made solid columnar body located rearward of the cleaning roller 105 and is pivotally supported so as to rotate around the third rotation shaft 106X (shown in FIG. 5 and FIG. 6) parallel to the first rotation shaft 105X while being in contact with the surface of the cleaning roller 105.

The blade 106A is such that a soft urethane sheet is cut to be slender, and the root side thereof is fixed at the rear edge side of the take-in port 104 in a state where the front end edge 106B is made parallel to the third rotation shaft 106X and is in contact with the surface of the raking roller 106.

Figure 3:
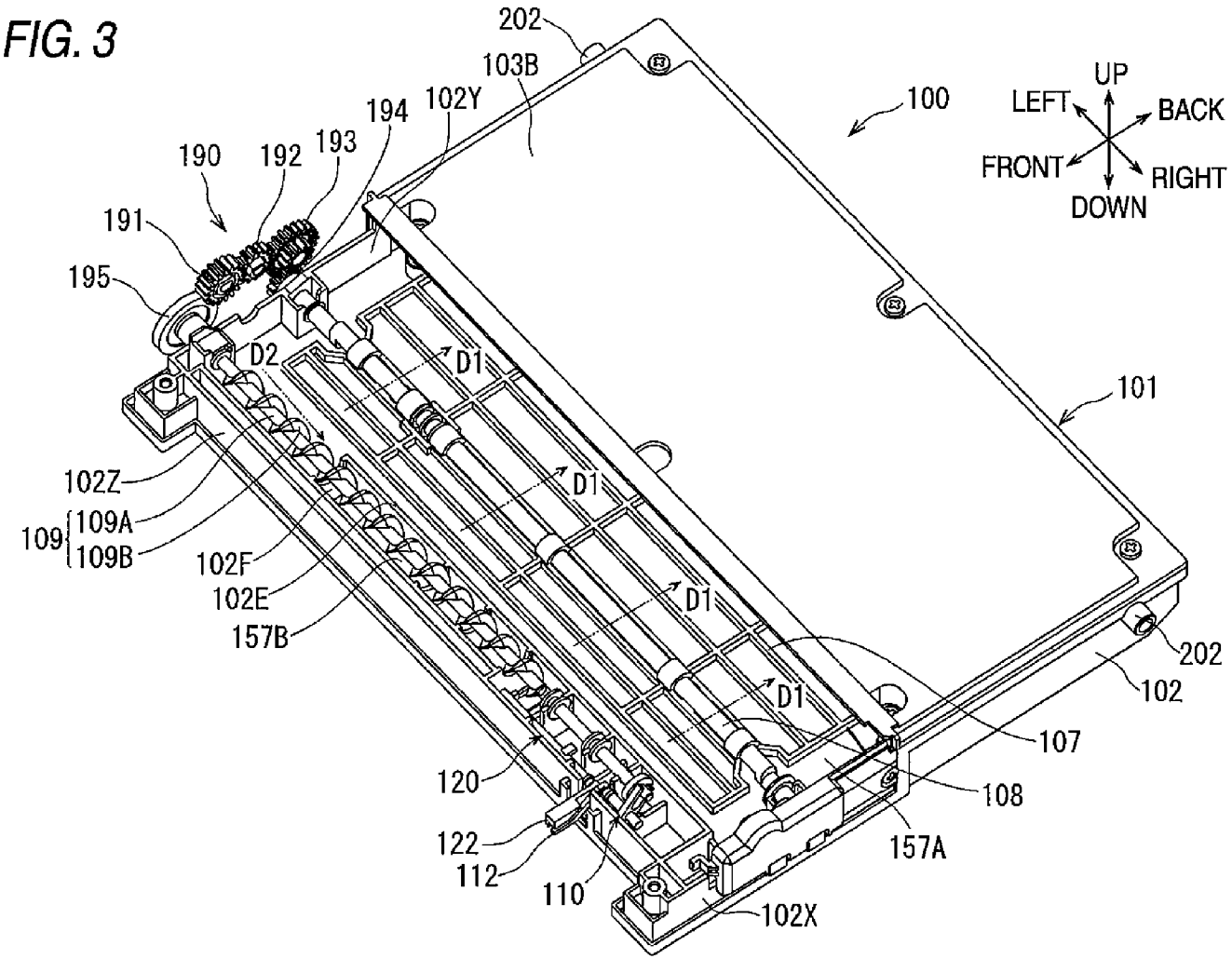
FIG. 3 is a perspective view of the toner recovery machine according to the embodiment (showing a state where the front side upper part cover, a cleaning roller, a raking roller, and a blade are removed)
Figure 4:
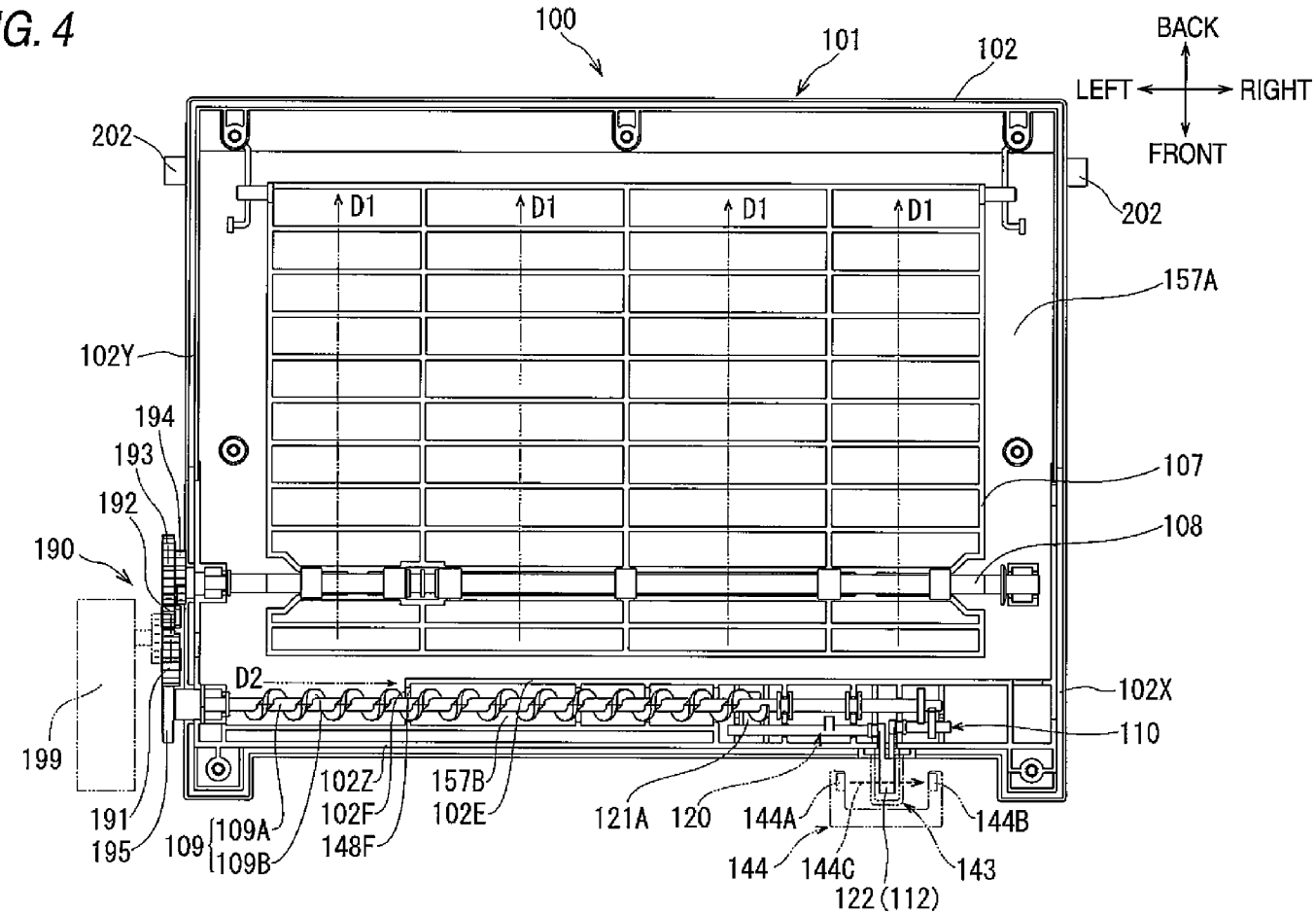
FIG. 4 is a top view of the toner recovery machine according to the embodiment (showing a state where the front and rear side upper part covers, a cleaning roller, a raking roller and a blade are removed)

As shown in FIG. 2, a drive force supply mechanism 190 is disposed at the left end side of the cleaning roller 105 in the waste toner recovery container 101. The drive force supply mechanism 190 is composed of a combination of a plurality of gears 191, 192, 193, 194 and 195 as shown in FIG. 3 and FIG. 4. Although illustration is omitted, the left end of the cleaning roller 105 is connected to the gear 191, which composes the drive force supply mechanism 190, so as to rotate integrally therewith. Also, although illustration is omitted, the left end of the raking roller 106 is connected to the gear 192, which composes the drive force supply mechanism 190 and is meshed with the gear 191, so as to rotate integrally therewith.

As shown in FIG. 4, a drive source 199 such as an electric motor, etc., installed at the frame member side is engaged with the drive force supply mechanism 190 in a state where the waste toner recovery machine 100 is mounted on the frame member. And, as a drive force of the drive source 199 is transmitted to the drive force supply mechanism 190, the gears 191 and 192, etc., rotate, and a drive force of the drive source 199 is supplied to the cleaning roller 105 and the raking roller 106. So, as shown in FIG. 1, the cleaning roller 105 is driven and rotated in the rotation direction opposite to the circulation direction R1 of the conveying belt 33, allowing waste toner, which is adhered to the surface of the conveying belt 33, to adhere to its surface so as to rub off the waste toner to remove the same from the conveying belt 33. The raking roller 106 is driven and rotated while being in contact with the surface of the cleaning roller 105 in a state where electric charge (in the embodiment, the negative charge) opposite to the charge given to the waste toner is applied, and electrically adsorbs waste toner adhered to the surface of the cleaning roller 105. And, the blade 106A peels off waste toner adsorbed by the raking roller 106 from the surface of the raking roller 106 by means of the end edge 106B thereof, and drops the waste toner into the waste toner container 101. Here, the position at which the end edge 106B is brought into contact with the surface of the raking roller 106 is called a "blade raking position R2" (shown in FIG. 6).

Figure 7:
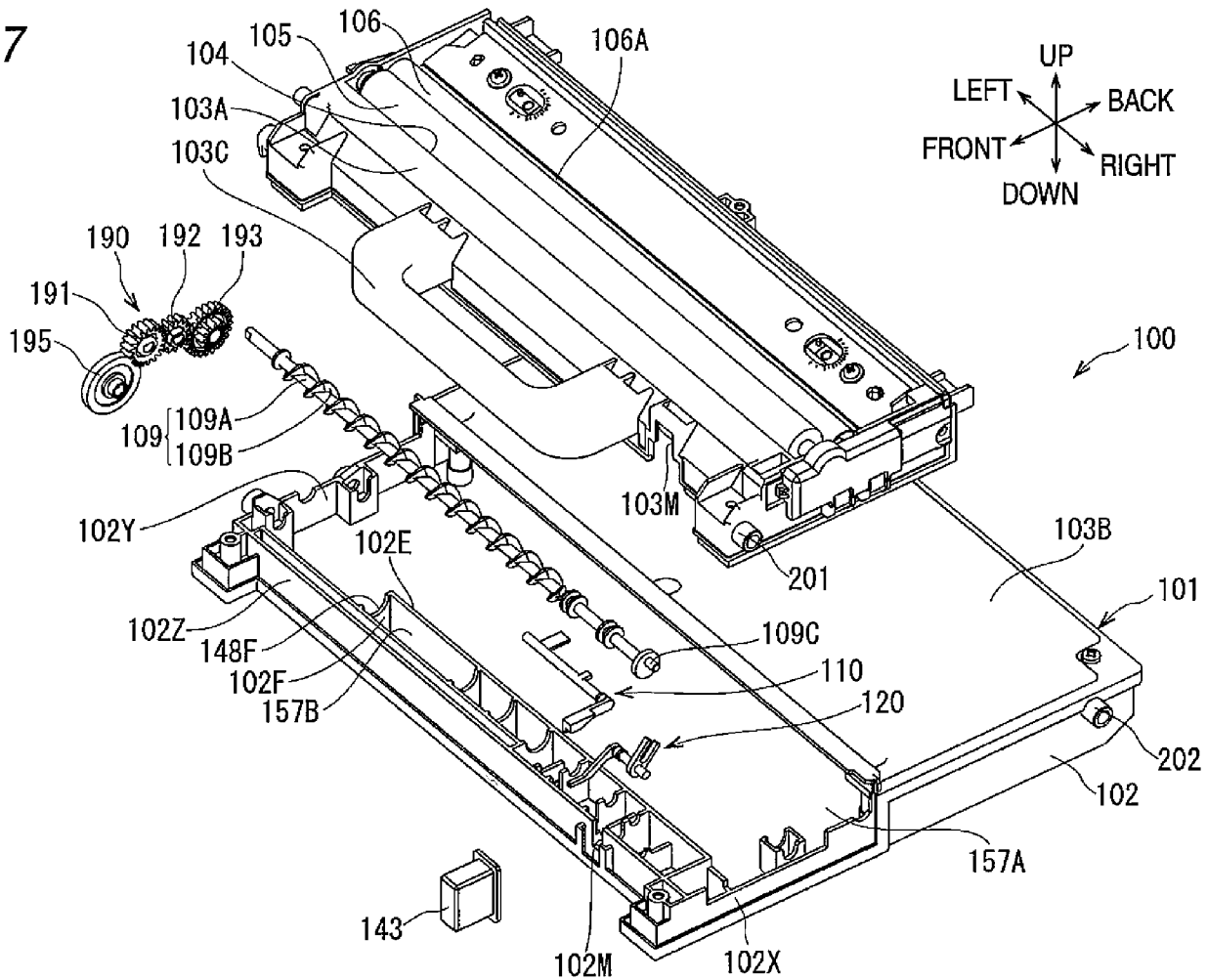
FIG. 7 is an exploded perspective view of the toner recovery machine according to the embodiment.

As shown in FIG. 4 and FIG. 7, a partition wall 102E extending like a rib in the left direction from the right side wall 102X and cutting out beforehand of the left side wall 102Y is erected at the front side of the container main body 102. Also, a rib-shaped partition wall 102F extending in the front-rear direction so as to link the left end part of the partition wall 102E and the doubly constructed front side wall 102Z is erected. A semi-circular recessed part 148F is formed on the upper end edge of the partition wall 102F.

Figure 8:
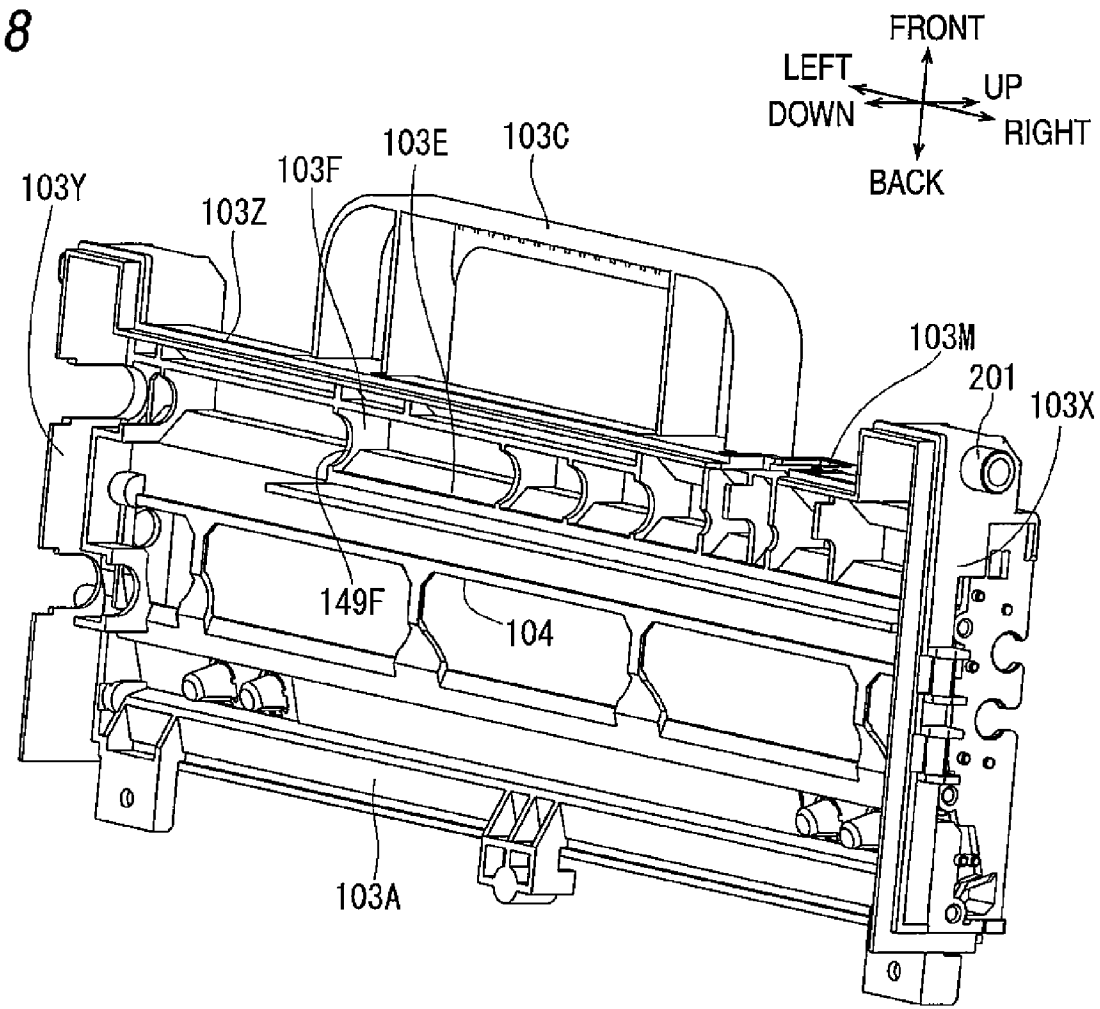
FIG. 8 is a perspective view showing the front side upper part cover of the toner recovery machine according to the embodiment.

On the other hand, as shown in FIG. 8, a partition wall 103E extending like a rib in the left direction from the right side wall 103X and cutting out beforehand of the left side wall 103Y is erected at the front side of the upper part cover 103A. Also, a rib-shaped partition wall 103F extending in the front-rear direction so as to link the left end part of the partition wall 103E and the doubly constructed front side wall 103Z is erected. A semi-circular recessed part 149F is formed at the lower end edge of the partition wall 103F.

Although illustration is omitted, if the upper part cover 103A is assembled in the container main body 102, the front side wall 102Z and the front side wall 103Z are coupled to each other, and the first inner wall 102Z, 103Z is formed. Also, the right side wall 102X and the right side wall 103X are coupled to each other, and the second inner wall 102X, 103X is formed. Further, the left side wall 102Y and the left side wall 103Y are coupled to each other, and the third inner wall 102Y, 103Y is formed.

In addition, although illustration is omitted, if the upper part cover 103A is assembled in the container main body 102, the partition wall 102F and the partition wall 103F are coupled to each other, and the first partition wall 102F, 103F is formed. The first partition wall 102F, 103F is configured so as to section the forward part of the internal space of the waste toner container 101 in the right-left direction. At this time, the recessed part 148F of the partition wall 102F and the recessed part 149F of the partition wall 103F are coupled to each other, wherein circular hole-shaped communication port 148F, 149F is formed in the first partition wall 102F, 103F.

Figure 5:
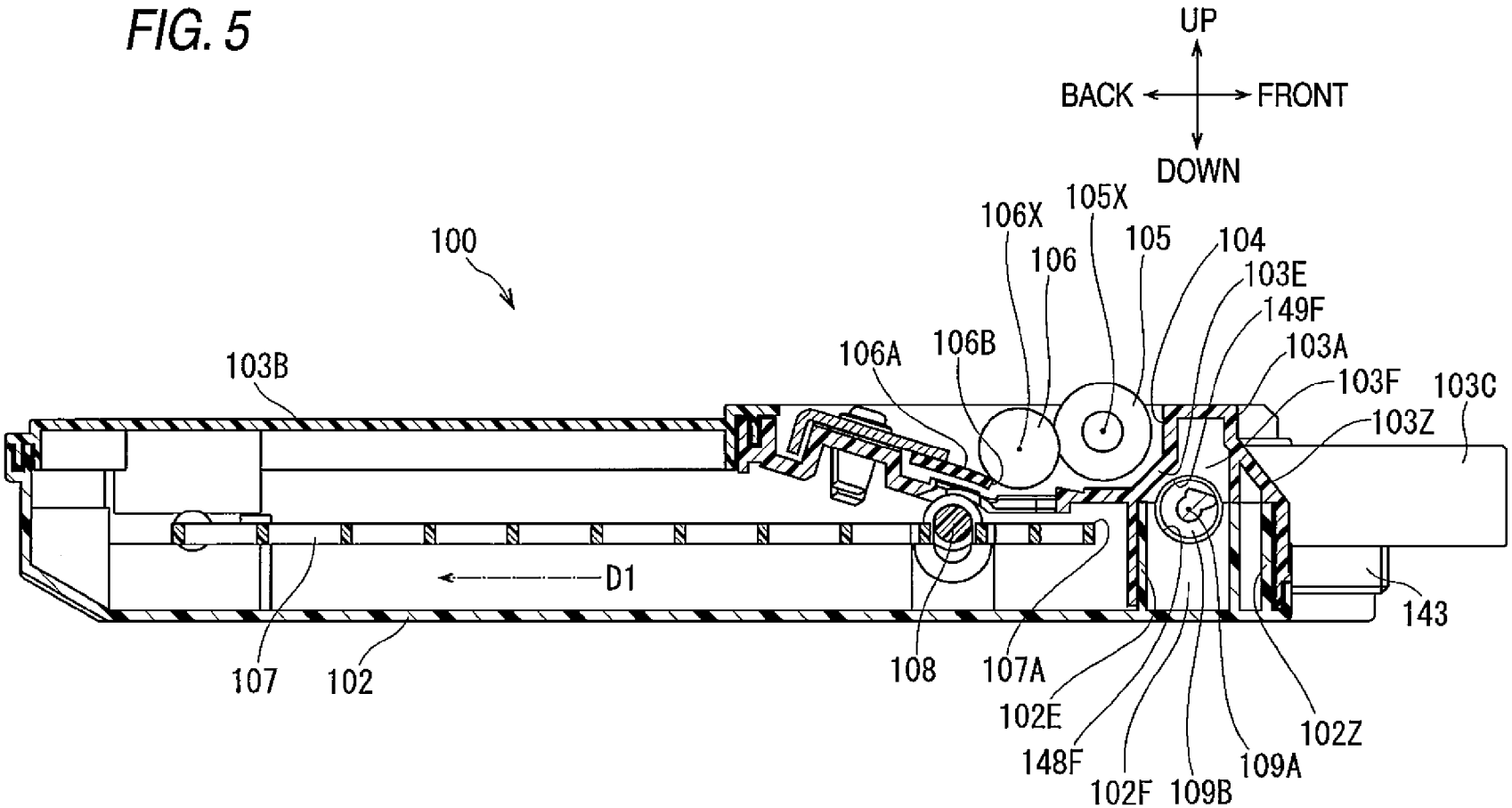
FIG. 5 is a sectional view, taken along the line V-V of FIG. 2, which shows the toner recovery machine according to the embodiment.
Figure 6:
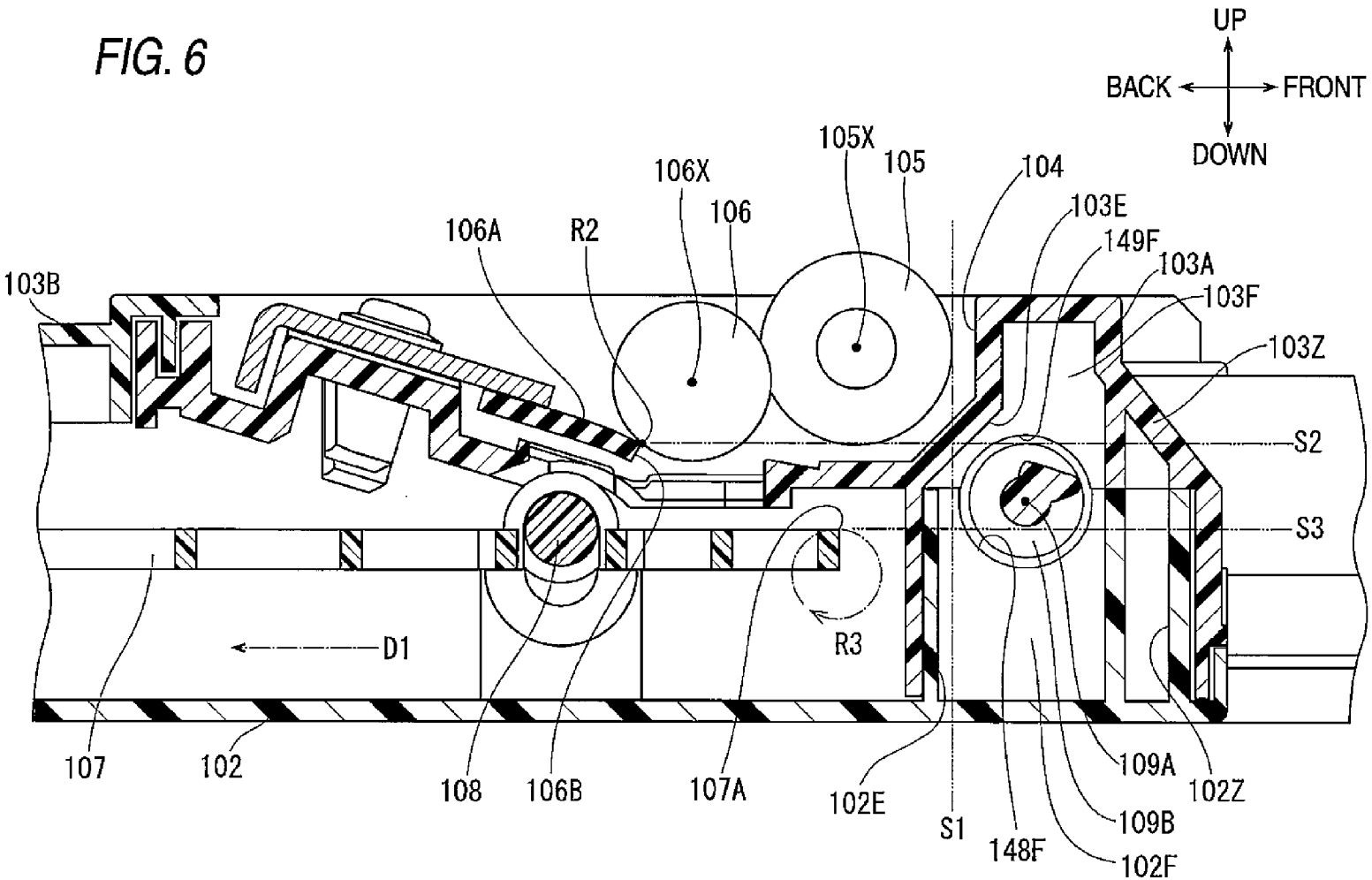
FIG. 6 is a sectional view with major parts enlarged, taken along the line V-V of FIG. 2, which shows the toner recovery machine according to the embodiment.

Further, as shown in FIG. 5 and FIG. 6, if the upper part cover 103A is assembled in the container main body 102, the partition wall 102E and the partition wall 103E are coupled to each other, and the second partition wall 102E, 103E is formed. The second partition wall 102E, 103E is configured so as to section the internal space of the waste toner container 101 in the front-rear direction thereof.

As shown in FIG. 3 and FIG. 4, the internal space of the waste toner container 101 is sectioned to a waste toner accommodation space 157A to accommodate a large amount of waste toner and a detection space 157B to detect the piled-up amount of waste toner by means of the first partition wall 102F, 103F and the second partition wall 102E, 103E. The waste toner accommodation space 157A and the detection space 157B are caused to communicate with each other by a communication port composed of the recessed parts 148F and 149F. The waste toner accommodation space 157A corresponds to the first space of the present invention, and the detection space 157B corresponds to the second space of the present invention.

As shown in FIG. 5 and FIG. 6, a crankshaft 108 is disposed in the waste toner accommodation space 157A, which is located in the vicinity of the cleaning roller 105 and rearward and lower portion of the raking roller 106, and is pivotally supported so as to rotate around the rotation shaft parallel to the first rotation shaft 105X and the third rotation shaft 106X. Further, a flat plate-shaped lattice member 107 is disposed in the waste toner accommodation space 157A, which is coupled to the crankshaft 108 and extends in the direction apart from the cleaning roller 105 along the bottom surface of the waste toner container from the vicinity of the cleaning roller 105.

As shown in FIG. 4, the left end of the crankshaft 108 is connected to the gear 194, which composes the drive force supply mechanism 190, so as to rotate integrally therewith. And, when the drive force of the drive source 199 is transmitted to the drive force supply mechanism 190, the gear 194 rotates, and the drive force of the drive source 199 is also supplied to the crankshaft 108. So, the crankshaft 108 is driven and rotated, and the lattice member 107 cyclically oscillates in the front-rear direction in line therewith.

Waste toner peeled off from the raking roller 106 by the blade 106A is gradually piled-up by the lattice member 107, which cyclically oscillates in the front-rear direction, in the direction apart from the cleaning roller 105, that is, toward the rearward of the waste toner accommodation space 157A after the waste toner first drops forward of the waste toner accommodation space 157A. Here, the direction apart from the cleaning roller 105 is called the "first pile-up direction D1" (shown in FIG. 3 through FIG. 6).

At this time, as shown in FIG. 6, the lattice member 107 is disposed so that the trajectory R3 of the upper end edge 107A at the cleaning roller 105 side of the lattice member 107 and the first rotation shaft 105X have an overlapping portion in the vertical direction. In other words, the upper end edge 107A of the lattice member is positioned in the vertical direction from the cleaning roller 105 within two times of the radius of the cleaning roller 105. Therefore, the waste toner piled under the cleaning roller 105 is actively conveyed in the first pile-up direction D1 by the crankshaft 108 and the lattice member 107.

And, if waste toner reaches the rear end of the waste toner accommodation space 157A and is thereby dammed, the waste toner begins gradually piling up at the forward side of the waste toner accommodation space 157A. Further, as the waste toner is further piled-up in the waste toner accommodation space 157A, the waste toner flows into the detection space 157B through the communication port (the recessed parts 148F and 149F).

As shown in FIG. 3 through FIG. 6, a conveying screw 109 including the second rotation shaft 109A parallel to the first rotation shaft 105X and an impeller 109B spirally formed around the second rotation shaft 109A is disposed forward of the second partition wall 102E, 103E of the waste toner container 101, that is, in the detection space 157B. The conveying screw 109 is inserted into the communication port (the recessed parts 148F and 149F) and connects the waste toner accommodation space 157A and the detection space 157B.

The left end of the second rotation shaft 109A is connected to the gear 195, which composes the drive force supply mechanism 190, so as to rotate integrally therewith. On the other hand, a column-shaped eccentric shaft part 109C (Refer to FIG. 9 and FIG. 10) having an axis parallel to the rotation axis of the second rotation shaft 109A projects from the right end portion of the second rotation shaft 109A.

As the drive force of the drive source 199 is transmitted to the drive force supply mechanism 190, the gear 195 also rotates, and the drive force of the drive source 199 is supplied to the second rotation shaft 109A. So, the conveying screw 109 is driven and rotated, the spiral impeller 109B conveys waste toner from the left end side of the second rotation shaft 109A to the right end side thereof. As a result, waste toner that cannot be accommodated in the waste toner accommodation space 157A is actively conveyed into the detection space 157B via the communication port (the recessed parts 148F and 149F), and is gradually piled-up from left to right in the detection space 157B. Here, the direction oriented from the left end side of the second rotation shaft 109A to the right end side thereof is called the "second pile-up direction D2" (shown in FIG. 3 through FIG. 4). According to the rotation of the second rotational shaft, the rotation of the second conveyer defines a radius. In this exemplary embodiment, the radius is defined by the edge of the impeller 109B of the conveying screw 109.

In the present embodiment, the relative positional relationship between the conveying screw 109, the cleaning roller 105, the raking roller 106, the blade 106A and the lattice member 107 is defined as described below.

As shown in FIG. 6, as the first rotation shaft 105X of the cleaning roller 105 is the basis of the positioning for each member, the crankshaft 108 and the lattice member 109 are located rearward with respect to the first rotation shaft 105X. On the contrary, the conveying screw 109 (the second rotation shaft 109A) is located forward with respect to the first rotation shaft 105X. That is, the conveying screw 109 is located at the opposite side of the crankshaft 108 and the lattice member 107 on the basis of the first rotation shaft 105X. In other words, the conveying screw 109, the cleaning roller 105, and the lattice member 107 are positioned in this order along the first pile-up direction D1 when viewed along the second pile-up direction. At least two of the conveying screw 109, the cleaning roller 105, and the lattice member 107 may overlap in the up-down direction in FIG. 6. In addition, as has been made clear based on that a perpendicularly extending auxiliary line S1 (shown in FIG. 6) can be arranged between the cleaning roller 105 and the conveying screw 109, the conveying screw 109 is located in a positional relationship in which it does not overlap the cleaning roller 105 in the vertical direction. In other words, with respect to the positioning relationship between the cleaning roller 105 and the conveying screw 109, the sum of the radius of the cleaning roller 105 and the radius defined by the rotation of the conveying screw 109 is smaller than a distance in the first pile-up direction between the first rotation shaft 105X and the second rotation shaft 109A. The reason is to accommodate waste toner up to a space under the first rotation shaft 105X, that its a space under the cleaning roller 105 and up to the vicinity thereof. Also, since the conveying screw 109 does not overlap the cleaning roller 105 in the vertical direction, the conveying screw 109 can be disposed upward in the waste toner container 101 independently from the cleaning roller 105 without any restriction by the cleaning roller 105.

Further, as shown in FIG. 6, the upper end of the impeller 109B of the conveying screw 109 is in contact with the auxiliary line S2 from below, the auxiliary line S2 horizontally extending forward from the blade raking position R2. That is, the upper end of the impeller 109B of the conveying screw 109 is located at the same height as the blade raking position R2. The reason therefor is that the upper surface of the plied-up waste toner is prevented from reaching the blade raking position R2 before waste toner reaches the upper end of the conveying screw 109. Also, the upper end of the impeller 109B may be positioned downward with respect to the blade raking position R2.

In addition, as shown in FIG. 6, the second rotation shaft 109A is located at a position upper than the auxiliary line S3 horizontally extending forward from an upper limit of the trajectory R3 of oscillation of the upper end edge 107A of the lattice member 107. In other words, in this exemplary embodiment, the first rotation shaft 105X, the second rotation shaft 109A and the upper end edge 107A of the lattice member 107 are positioned in this order with respect to the up-down direction when viewed from the second pile-up direction. The reason therefor is that waste toner piled-up above the upper end edge 107A of the lattice member 107 is prevented from flowing into the conveying screw 109 side.

Next, a description is given of the first displacement portion 110 and the second displacement portion 120, which is one example of displacement means provided in the detection space 157B. As shown in enlargement in FIG. 9, the first displacement portion 110 and the second displacement portion 120 are provided adjacent to the second rotation shaft 109A of the conveying screw 109 between the second partition wall 102E, 103E and the first inner wall 102Z, 103Z.

Figure 9:
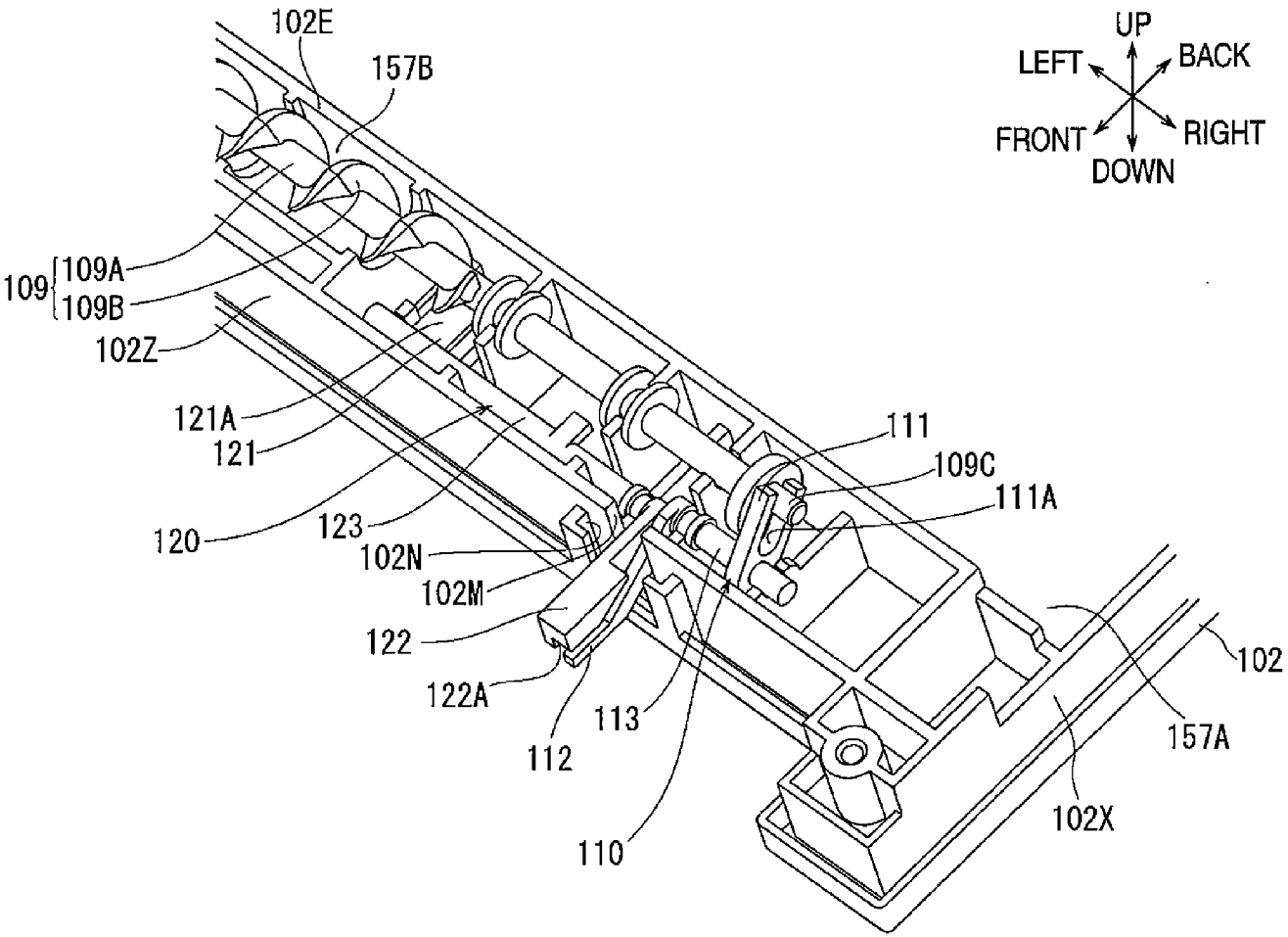
FIG. 9 is a perspective view, with major parts enlarged, showing the toner recovery machine according to the embodiment (which shows a conveying screw, the first displacement portion and the second displacement portion)
Figure 10:
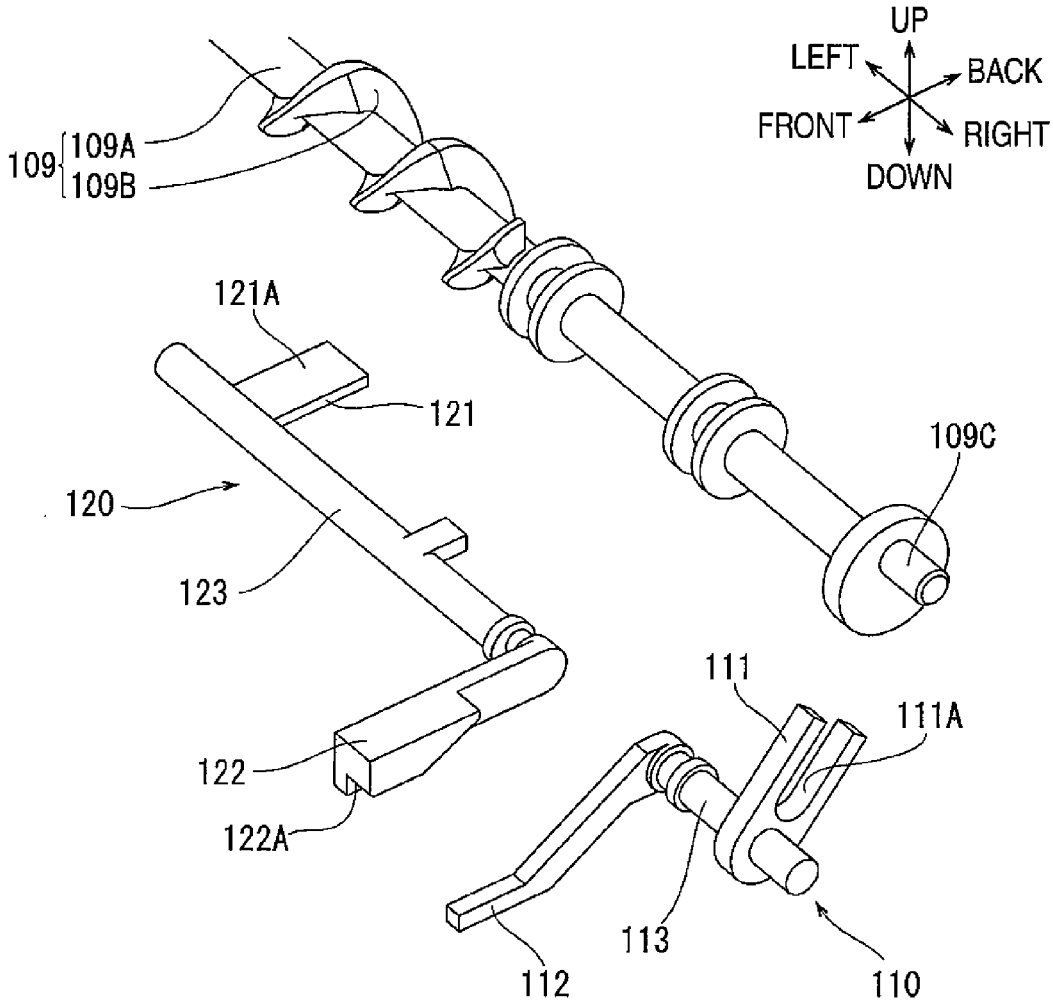
FIG. 10 is a perspective view of the toner recovery machine according to the embodiment, which shows the conveying screw, the first displacement portion and the second displacement portion separated from each other.

As shown in FIG. 9 and FIG. 10, the first displacement portion 110 includes a first connection part 113, a first passive part 111 and a first shielding part 112. The first connection part 113 is a slender columnar rod member pivotally supported so as to rotate around the axis parallel to the second rotation shaft 109A. The first passive part 111 is a bifurcated member projecting from the right end side of the first connection part 113 outward of the diameter with respect to the axis of the first connection part 113. As shown in FIG. 9, the first passive part 111 is assembled in a state where the eccentric shaft part 109C of the second rotation shaft 109A is inserted in a slit 111A that forms the bifurcated shape. The first shielding part 112 is a slender square rod-shaped member projecting from the left end side of the first connection part 113 outward of the diameter with respect to the axis of the first connection part 113, forward of the first connection part, which is opposite to the extending direction of the first passive part 111.

As shown in FIG. 7 through FIG. 9, recessed parts 102M and 103M notched so as to avoid the first shielding part 112 projecting forward are formed at the first inner wall 102Z, 103Z. As shown in FIG. 9, the first shielding part 112 further projects forward from the first inner wall 102Z, 103Z (not shown in FIG. 9) via the recessed parts 102M and 103M (not shown in FIG. 9). And, as shown in FIG. 11 and FIG. 12, if the eccentric shaft part 109C eccentrically rotates in line with rotation of the conveying screw 109, the first shielding part 112 oscillates in the vertical direction via the first passive part 111, which is engaged with the eccentric shaft part 109C, and the first connection part 113.

On the other hand, as shown in FIG. 9 and FIG. 10, the second displacement portion 120 includes a second connection part 123, a second passive part 121, and a second shielding part 122. The second connection part 123 is a slender columnar rod member pivotally supported so as to rotate around an axis parallel to the second rotation shaft 109A. The right end of the second connection part 123 faces the left end of the first connection part 113. The left end of the second connection part 123 extends to the right end part of the impeller 109B. The second passive part 121 is a planar member projecting from the left end side of the second connection part 123 outward of the diameter with respect to the axis of the second connection part 123, and rearward of the second connection part. As shown in FIG. 9, the second passive part 121 is assembled in a state where the stacking surface 121A, which is the upper surface of the planar member, is positioned at the lower right end part of the impeller 109B. The second shielding part 122 is a slender pillar-shaped member projecting from the right end side of the second connection part 123 outward of the diameter with respect to the axis of the second connection part 123, and forward of the second connection part, which is opposite to the extending direction of the second passive part 121.

As shown in FIG. 7 through FIG. 9, the second shielding part 122 further projects forward from the first inner wall 102Z, 103Z via the recessed parts 102M and 103M as in the first shielding part 112. And, as shown in FIG. 9 and FIG. 10, the second shielding part 122 is located at the upper side of the first shielding part 112, and when the second shielding part 122 is brought into contact with the first shielding part 112, the first shielding part 112 is accommodated in the notched part 122A.

Figure 11:
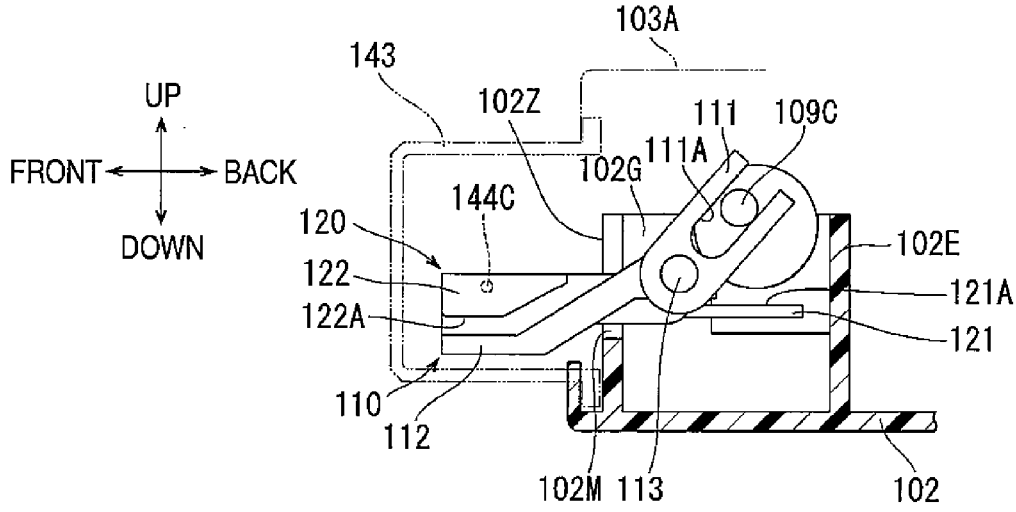
FIG. 11 is a sectional view, with major parts enlarged, describing displacement of the first displacement portion and the second displacement portion in line with rotation of the conveying screw in the toner recovery machine according to the embodiment.
Figure 12:
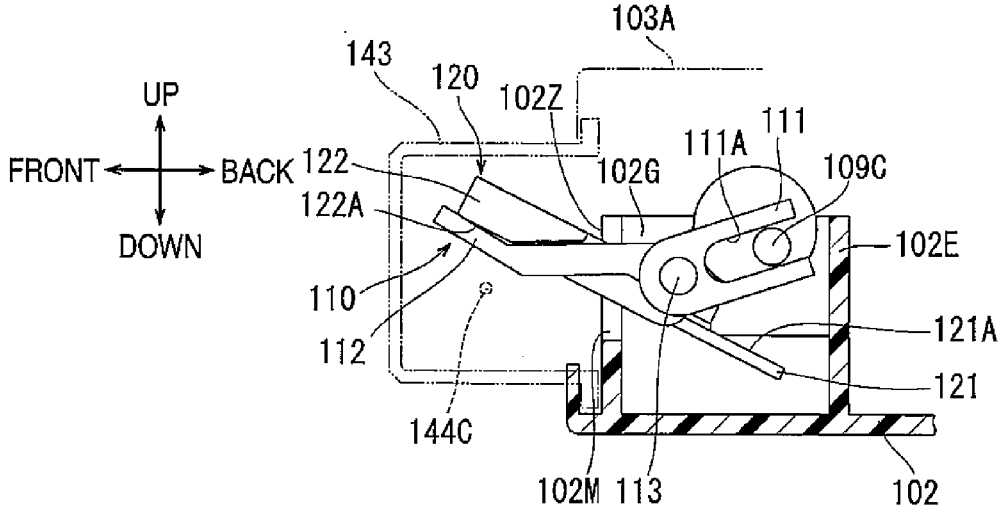
FIG. 12 is a sectional view, with major parts enlarged, describing displacement of the first displacement portion and the second displacement portion in line with rotation of the conveying screw in the toner recovery machine according to the embodiment.

Since the weight of the second shielding part 122 is heavier than that of the second passive part 121, in the second displacement portion 120, the second shielding part 122 side descends in a state where no external force operates on the second passive part 122 and the second shielding part 122, and is retained in such a posture as shown in FIG. 11 by means of a stopper (not illustrated). In this case, the second passive part 121 and the second shielding part 122 are turned almost in the horizontal direction. On the other hand, although illustration is omitted, as waste toner is piled-up on the stacking surface 121A of the second passive part 121, as shown in FIG. 12, the balance between the second shielding part 122 and the second passive part 121 changes due to the weight of waste toner or resistance thereof, and the second displacement portion 120 is inclined so that the second passive part 121 side turns downward. As a result, the second displacement portion 120 is retained so that the second passive part 121 descends to a downward position, and, at the same time, the second shielding part 122 ascends to an upward position. Even where the second displacement portion 120 is retained in a state shown in FIG. 12, the first shielding part 112 independently oscillates in the vertical direction by eccentric rotation of the eccentric shaft part 109C.

In a state where the toner recovery machine 100 is mounted on a frame member, as shown in FIG. 4, the first shielding part 112 and the second shielding part 122 are entered into a state where they project toward an optical sensor 144 as an example of displacement detecting means provided at the frame member side. The optical sensor 144 (shown only in FIG. 4) has a light emitting part 144A and a light receiving part 144B, which are facing each other in the right-left direction with spacing therebetween. The light emitting part 144A is located at the left side of the first shielding part 112 and the second shielding part 122, and the light receiving part 144B is located at the right side of the first shielding part 112 and the second shielding part 122. The optical sensor 144 is a publicly known sensor that detects shielding and opening of an optical path 144C provided between the light emitting part 144A and the light receiving part 144B. As FIG. 11 and FIG. 12 show the relative positional relationship between the optical path 144C, the first shielding part 112 and the second shielding part 122, the first shielding part 112 and the second shielding part 122, which can be displaced in the vertical direction, can take the position of shielding the optical path 144C and a position of opening the same.

For example, before waste toner is piled-up on the stacking surface 121A of the second passive part 121 in the detection space 157B, the eccentric shaft part 109C eccentrically rotates by rotation of the conveying screw 109 and the first passive part 111 engaged with the eccentric shaft part 109C oscillates as shown in FIG. 11 and FIG. 12. So, the first shielding part 112 and the second shielding part 122 oscillate in the vertical direction integrally with each other via the first connection part 113, and take the position of shielding the optical path 114C (for example, the descent position shown in FIG. 11) and the position of opening the same (for example, the ascent position shown in FIG. 12). That is, the first shielding part 112 and the second shielding part 122 that move up and down integrally with each other shield the optical path 144C once when the eccentric shaft part 109C rotates once.

On the other hand, although illustration is omitted, as waste toner is piled-up on the stacking surface 121A of the second passive part 121 in the detection space 157B, the balance between the second passive part 121 and the second shielding part 122 changes due to the weight of the waste toner or resistance thereof. And, the second passive part 121 is retained at the downward position, and the second shielding part 122 is retained at a position upwardly apart from the first shielding part 112 that cyclically moves up and down, thereby opening the optical path 144C. On the other hand, the first shielding part 112 independently moves up and down in line with rotation of the eccentric shaft part 109C, and takes a position of shielding the optical path 114C (for example, an intermediate position between the descent position shown in FIG. 11 and the ascent position shown in FIG. 12) and a position of opening the same (for example, the descent position shown in FIG. 11 or the ascent position shown in FIG. 12). That is, the first shielding part 112 that independently moves up and down shields the optical path 144C two times while the eccentric shaft part 109C rotates once. In addition, at this time, the time required to shield the optical path 144C is shorter than in the case where the first shielding part 112 and the second shielding part 122 oscillate integrally with each other.

Thus, since the shielding pattern of the optical path 144C is changed based on whether or not waste toner is piled-up on the stacking surface 121A of the second passive part 121, the output signal from the optical sensor 144 changes in line therewith. Therefore, a publicly known control portion consisting of a CPU, etc., which is incorporated in the printer 1, is able to determine, based on the output signal from the optical sensor 144, whether or not waste toner has been piled-up on the stacking surface 121A of the second passive part 121. And, where it is determined that waste toner has been piled-up on the stacking surface 121A, the control portion can take an appropriate measure such as notification to a user that the volume of waste toner is nearly full in the waste toner container ("Near Full").

Also, as shown in FIG. 2 and FIG. 4, a resin-made transparent cover 143, which covers up the first shielding part 112 and the second shielding part 122 without shielding the optical path 144C, is mounted on the first inner wall 102Z, 103Z.

8. Detachably Mounted Configuration of the Toner Recovery Machine to a Frame Member As shown in FIG. 2, a pair of first pin parts 201 projecting outward in the width direction are integrally formed forward of both sides in the width direction (the right-left direction) of the upper part cover 103A in the toner recovery machine 100. In addition, a pair of second pin parts 202 projecting outward in the width direction are integrally formed rearward of both sides in the width direction (the right-left direction) of the container main body 102.

Figure 13:
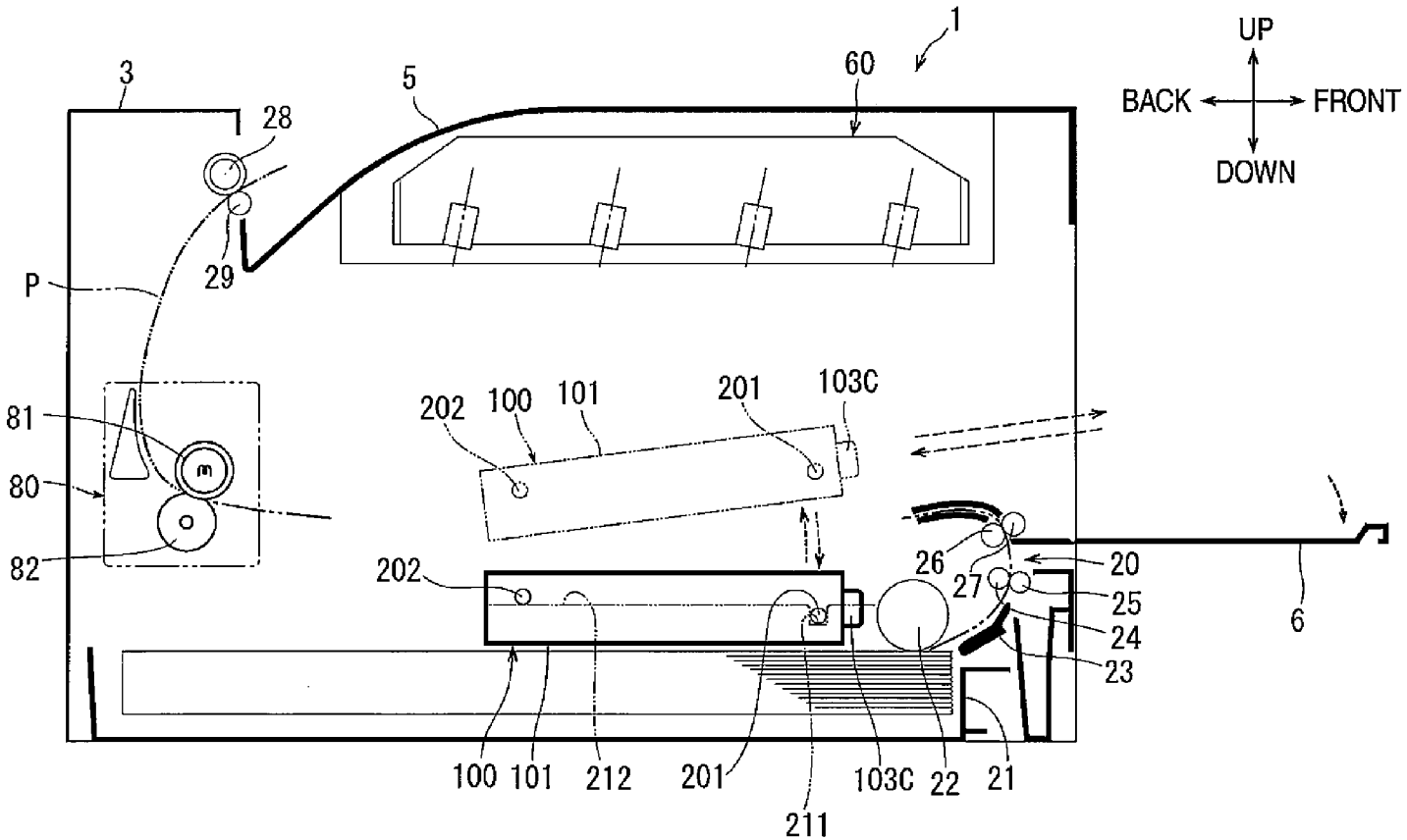
FIG. 13 is a schematically sectional view describing a configuration in which the toner recovery machine according to the embodiment is detachably mounted to a frame member of an image forming apparatus.
Figure 14:
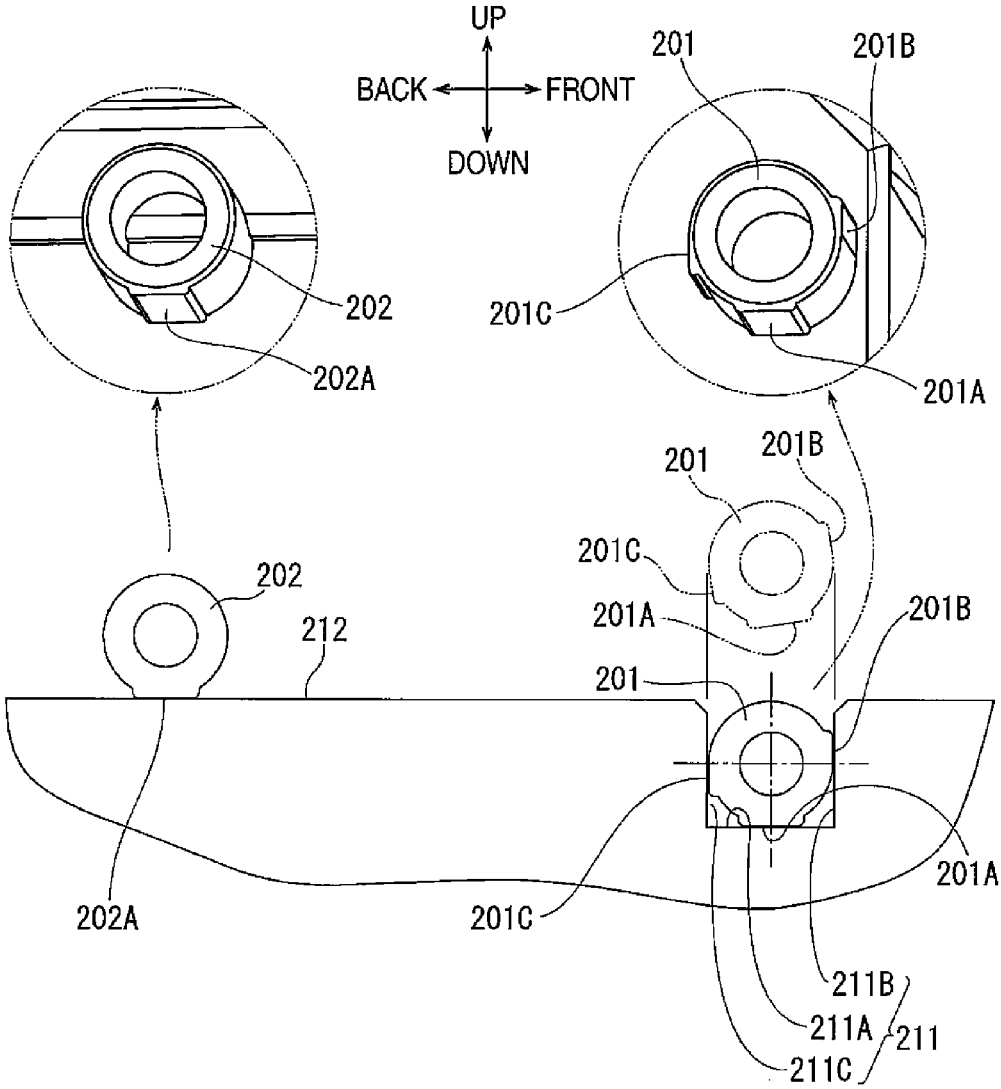
FIG. 14 is a view describing a configuration in which the toner recovery machine according to the embodiment is detachably mounted to a frame member of an image forming apparatus.

On the other hand, as shown in FIG. 13 and FIG. 14, a pair of recessed parts 211 (only one thereof is shown) that support the first pin parts 201 and a pair of flat planes 212 (only one thereof is shown) that support the second pin parts 202 are formed on the frame member of the housing 3.

The recessed part 211 is a notch rectangularly recessed downward when being observed in the right-left direction, and has a horizontal bottom side 211A, a vertical front side 211B and a vertical rear side 211C. The recessed part 211 receives the first pin part 201, which is fitted from upward, from downward thereof, regulates the position of the first pin part 201 in the vertical direction by the bottom side 211A, and regulates the position of the first pin part 201 in the front-rear direction by the front side 211B and the rear side 211C.

The flat plane 212 is a plane horizontally extending in the front-rear direction, receives the second pin part 202, which is placed from upward, from downward thereof, and regulates the position of the second pin part 202 in the vertical direction.

As shown in FIG. 14, a flat part 201A that is brought into facial contact with the bottom side 211A is formed at the lower part of the columnar-shaped first pin part 201, a flat part 201B that is brought into facial contact with the front side 211B is formed at the front part of the first pin part 201, and a flat part 201C that is brought into facial contact with the rear side 211C is formed at the rear part of the first pin part 201.

The flat part 201B is formed upward from the horizontal line passing through the center of the first pin part 201. On the other hand, the flat part 201C is formed downward from the horizontal line passing through the center of the first pin part 201. Therefore, as shown with a two-dotted chain line in FIG. 14, the first pin part 201 is displaced upward while being turned counterclockwise on the paper, and is able to be disconnected from the recessed part 211.

Also, a flat part 202A that is brought into facial contact with a flat plane 212 is formed at the lower part of the columnar-shaped second pin part 202.

As shown in FIG. 13, in a state where the image forming unit 10 and the conveying unit 30 are removed from the housing 3, when the toner recovery machine 100 is raised upward while the handle 103C of the toner recovery machine 100 is held, the first pin part 201 is removed from the recessed part 211, and the toner recovery machine 100 can be removed from the housing 3 in the state as it is. In addition, the toner recovery machine 100 can be mounted on the frame member of the housing 3 thereof in the reverse procedure of removal.

Here, since the first and the second pin parts are formed of a columnar shape not having any flat part in a prior art toner recovery machine, the first pin part and the second pin part are apt to wear due to vibrations during transport. Therefore, there is a fear that positional displacement of the toner recovery machine occurs with respect to the frame member. In that case, there arises a possibility that recovery of waste toner becomes imperfect resulting from the relative positional relationship between the toner recovery machine and the conveying belt.

On the contrary, the toner recovery machine 100 is able to prevent the first pin part 201 and the second pin part 202 from being worn, by virtue of the flat parts 201A through 201C and 202A. Accordingly, any play is hardly brought about between the toner recovery machine 100 and the frame member, wherein it is possible to prevent the toner recovery machine 100 from being subjected to positional displacement with respect to the frame member. Therefore, imperfect recovery of waste toner resulting from displacement of the relative positional relationship between the toner recovery machine 100 and the conveying belt 33 can be prevented from occurring, and the image forming quality can be kept favorable.

Actions and Effects

With the toner recovery machine 100 according to the embodiment, since the conveying screw 109 is located at the opposite side of the crankshaft 108 and the lattice member 107 on the basis of the first rotation shaft 105X, and is located in a positional relationship in which the conveying screw 109 does not overlap the cleaning roller 105 in the vertical direction, waste toner can be accommodated up to the space under the first rotation shaft 105X, that is, the space under the cleaning roller 105, and up to the vicinity thereof. Accordingly, in comparison with a prior art toner recovery machine, the filling ratio of waste toner accommodated in the waste toner container 101 can be easily increased. Furthermore, since the conveying screw 109 does not overlap the cleaning roller 105 in the vertical direction, the conveying screw 109 can be disposed upward in the waste toner container 101 independently from the cleaning roller 105 without any restriction by the cleaning roller 105. Therefore, the thickness of the waste toner container 101 in the vertical direction can be easily thinned.

Therefore, with the toner recovery machine 100 according to the embodiment, it is possible to achieve downsizing and thinning as the entire unit while increasing the filling ratio of waste toner accommodated in the waste toner container 101. As a result, such inconvenience as an increase in time and labor for a user to replace the toner recovery machine and an increase in maintenance costs is hardly caused to occur.

Further, provisionally, if the conveying screw 109 is located further upward in the waste toner container 101, further thinning of the toner recovery machine 100 can be brought about. However, if the upper end of the impeller 109B of the conveying screw 109 is raised beyond the blade raking position R2, the upper surface of the piled-up waste toner reaches the blade raking position R2 before waste toner reaches the upper end of the impeller 109B of the conveying screw 109. As a result, it becomes difficult for the blade 106A to normally rake away waste toner. On the contrary, in the toner recovery machine 10, since the upper end of the impeller 109B of the conveying screw 109 is located at the same height as that of the blade raking position R2, it is possible to prevent the upper surface of the piled-up waste toner from reaching the blade raking position R2 before waste toner reaches to the upper end of the impeller 109B of the conveying screw 109, and to prevent malfunctioning of the raking. Therefore, it is possible to reliably achieve thinning of the toner recovery machine 100 and to reliably prevent malfunctioning of the raking of waste toner by the blade 106A.

Further, according to the toner recovery machine 100, waste toner can be reliably conveyed in the first pile-up direction D1 by the crankshaft 108 and the lattice member 107. For this reason, it is possible to greatly secure the quantity of waste toner accommodated in the waste toner container 101 until it becomes difficult for the crankshaft 108 and the lattice member 107 to convey waste toner in the first pile-up direction D1. Therefore, the timing at which the conveying screw 109 begins to convey waste toner in the second pile-up direction D2 can be delayed, wherein the filling ratio of waste toner can be reliably increased.

In addition, provisionally, if the second rotation shaft 109A of the conveying screw 109 is located at a lower portion of the waste toner container 101, waste toner that will be piled-up in a space over the upper end edge 107A at the cleaning roller 105 side of the lattice member 107 becomes apt to flow into the conveying screw 109 side. On the contrary, in the toner recovery machine 100, by locating the second rotation shaft 109A at a position above the trajectory R3 traced by the upper end edge 107A while the oscillation of the lattice member 107, it is possible to prevent the waste toner, which is piled-up upward of the upper end edge 107A of the lattice member 107, from flowing into the conveying screw 109 side. Thereby, the timing at which the conveying screw 109 begins to convey waste toner in the second pile-up direction D2 can be delayed, wherein the filling ratio of waste toner can be reliably increased.

Further, in the toner recovery machine 100, the lattice member 170 is disposed so that the trajectory R3 of the upper end edge 107A of the lattice member 107 overlaps the first rotation shaft 105X in the vertical direction. Therefore, waste toner piled-up in the space under the first rotation shaft 105X, that is, the space under the cleaning roller 105 can be conveyed in the first pile-up direction D1 by the crankshaft 108 and the lattice member 107, wherein the filling ratio of waste toner can be further reliably increased.

In addition, in the toner recovery machine 100, since the conveying screw 109, the cleaning roller 105, the raking roller 106 and the crankshaft 108, which are related to recovery and accumulation of waste toner into the waste toner container 101, are provided in juxtaposition in the waste toner container 101 in this order from the upstream side to the downstream side in the first pile-up direction D1, thinning of the toner recovery machine can be further reliably achieved.

Further, as shown in FIG. 3 and FIG. 4, in the toner recovery machine 100, the waste toner container 101 includes: the first inner wall 102Z, 103Z located at the upstream side in the first pile-up direction D1; the second inner wall 102X, 103X located at the downstream side in the second pile-up direction D2; the first partition wall 102F, 103F having one end connected to the first inner wall 102Z, 103Z, extending along the first pile-up direction D1, and having the communication port 148F, 149F through which the conveying screw 109 is inserted; and the second partition wall 102E, 103E having one end connected to the other end of the first partition wall 102F, 103F, extending along the second pile-up direction D2 between the crankshaft 108 and the lattice member 107 and the conveying screw 109, and having the other end connected to the second inner wall 102X, 103X. And, the internal space of the waste toner container 101 is sectioned into the waste toner accommodation space 157A acting as the first space for accommodating the crankshaft 108, the lattice member 107 and a part of the conveying screw 109 and the detection space 157B acting as the second space for accommodating the remaining part of the conveying screw 109 by means of the first partition wall 102F, 103F and the second partition wall 102E, 103E.

With the above configuration, movement of waste toner accommodated in the waste toner container 101 toward the conveying screw 109 side is restricted by the first partition wall 102F, 103F and the second partition wall 102E, 103E, wherein the waste toner is further reliably conveyed in the first pile-up direction D1 by the crankshaft 108 and the lattice member 107. On the other hand, as waste toner cannot be completely accommodated in the waste toner accommodation space 157A, the waste toner is smoothly conveyed to the detection space 157B via the communication port 148F, 149F of the first partition wall 102F, 103F by means of the conveying screw 109, and is piled-up in the detection space 157B. Thus, since conveying action of waste toner by the crankshaft 108 and the lattice member 107 and that by the conveying screw 109 are prevented from interfering with each other, and respective conveying actions can be satisfactorily displayed, resultantly, waste toner can be efficiently filled in the waste toner accommodation space 157A and the detection space 157B.

Also, in the toner recovery machine 100, by detecting the displacement state of the first displacement portion 110 and the second displacement portion 120, which act as displacement means, by the optical sensor 144, it is possible to easily determine whether or not the amount of the waste toner in the waste toner container 101 reaches a predetermined amount ("Near Full"). And, as shown in FIG. 11 and FIG. 12, since the first displacement portion 110 and the second displacement portion 120 projects in the direction crossing the second pile-up direction D2 in a range downward from the upper surface of the waste toner container 101 (downward from the upper surface of the upper part cover 103A), and upward from the underside of the waste toner container 101 (upward from the underside of the container main body 102), thinning of the toner recovery machine 100 can be further reliably achieved.

Further, with the printer 1 according to the embodiment, which is provided with the conveying belt 33, the toner recovery machine 100, and the housing 3 for accommodating the conveying belt 33 and the toner recovery machine 100, downsizing and thinning of the entire printer 1 can be achieved by the above-mentioned actions and effects brought about by the toner recovery machine 100, and at the same time, such inconvenience as an increase in time and labor required for a user to replace the toner recovery machine 100 and an increase in maintenance costs is hardly caused to occur.

In the above, a description was given of the embodiment of the present invention. However, the present invention is not restricted by the above-described embodiment, and it is a matter of course that the invention may be subjected to various modifications and variations within the range not departing from the spirit thereof.

For example, the toner carrier is not restricted to the conveying belt 33 according to the embodiment. It may be a cylindrical photosensitive drum, etc.

Also, the first conveyer is not restricted to a configuration including the crankshaft 108 and the lattice member 107 according to the embodiment. It may be a conveying screw, etc. The second conveyer is not restricted to the conveying screw 109 according to the embodiment. It may be a multiple-stage screw, etc., in which a plurality of screws are disposed in series along the rotation shaft.

INDUSTRIAL APPLICABILITY

The exemplary embodiments of the present invention are applicable to an image forming apparatus.

The invention claimed is:

1. A toner recovery machine comprising:

a first roller having a radius and rotatable about a first axis, the first axis along a first direction, the first roller configured to contact a toner carrier;

a container configured to accommodate toner, the container comprising:

a first conveyer movable along a second direction perpendicular to the first direction; and a second conveyer rotatable about a second axis and having a radius defined by the rotation about the second axis, the second axis along the first direction, wherein the second conveyer, the first roller, and the first conveyer are positioned in this order along the second direction, wherein the sum of the radius of the first roller and the radius defined by the second conveyer is smaller than a distance in the second direction between the first axis and the second axis.

2. The toner recovery machine according to claim 1, wherein the first roller overlaps the first conveyer in a third direction perpendicular to the first and the second directions.

3. The toner recovery machine according to claim 1, wherein the second conveyer is a screw, and the radius defined by the second conveyer is defined as a radius of a circular trajectory drawn by an edge of the screw when viewed along the first direction.

4. The toner recovery machine according to claim 1, further comprising:

a second roller rotatable about a third axis along the first direction and touching the first roller; and a blade, an edge of which extending along the first direction and touching the second roller, wherein a distance in a third direction between the edge and the second axis is equal to or more than the radius of the second conveyer when viewed along the first direction, and wherein the third direction is perpendicular to the first direction and the second direction.

5. The toner recovery machine according to claim 1, wherein the first conveyer comprises:

a crank shaft along the first direction; and a lattice member extending along the second direction, swingable about the crank shaft, and having one end positioned in a third direction from the first roller, wherein the third direction is perpendicular to the first direction and the second direction, and the first axis, the second axis, and the one end of the lattice member are positioned in this order with respect to the third direction when viewed from the first direction.

6. The toner recovery machine according to claim 5, wherein the one end of the lattice member is positioned in the third direction from the first axis within two times of the radius of the first roller along the second direction.

7. The toner recovery machine according to claim 5, wherein the second conveyer, the first roller, the second roller, and the crank shaft are positioned in this order with respect to the second direction.

8. The toner recovery machine according to claim 1, wherein the container comprises:

a first wall extending along the first direction;

a second wall extending from the first wall along the second direction;

a first partition extending from the first wall along the second direction;

a second partition extending from the first partition along the first direction between the first axis and the second axis;

a first space defined by the first partition, the second partition, the first wall, and the second wall, and accommodating the first conveyer and a first part of the second conveyer; and a second space defined by the first partition, the second partition and the first wall, and accommodating a second part of the second conveyer.

9. The toner recovery machine according to claim 8, wherein the second space comprises:

a moving member movable, depending on an amount of toner in the second space, in a direction perpendicular to the second direction; and a detector configured to detect the amount of toner based on the movement of the moving member.

10. An image forming apparatus comprising:

a toner recovery machine including a first roller having a radius and rotatable about a first axis, the first axis along a first direction;

a container configured to accommodate toner, the container comprising:

a first conveyer movable along a second direction perpendicular to the first direction; and a second conveyer rotatable about a second axis and having a radius defined by the rotation about the second axis, the second axis along the first direction, wherein the second conveyer, the first roller, and the first conveyer are positioned in this order along the second direction, wherein the sum of the radius of the first roller and the radius defined by the second conveyer is smaller than a distance in the second direction between the first axis and the second axis;

a toner carrier touching the first roller; and a housing configured to accommodate the toner recovery machine and the toner carrier.

* * * * *